US006601773B2

(12) United States Patent
Saitoh et al.

(10) Patent No.: US 6,601,773 B2
(45) Date of Patent: Aug. 5, 2003

(54) HEAT PUMP TYPE HOT WATER SUPPLY APPARATUS

(75) Inventors: Masanobu Saitoh, Gunma (JP); Kiyoshi Koyama, Gunma (JP); Yoshinori Touya, Gunma (JP); Sadahiro Takizawa, Gunma (JP); Kazuaki Shikichi, Tochigi (JP); Shigeya Ishigaki, Gunma (JP); Hirokazu Izaki, Tochigi (JP); Hiroshi Mukaiyama, Gunma (JP); Osamu Kuwabara, Gunma (JP); Haruhisa Yamasaki, Gunma (JP); Satoshi Imai, Gunma (JP)

(73) Assignees: Sanyo Electric Co., Ltd., Moriguchi (JP); Sanyo Electric Air Conditioning, Ashikaga (JP)

( * ) Notice: Subject to any disclaimer, the term of this patent is extended or adjusted under 35 U.S.C. 154(b) by 19 days.

(21) Appl. No.: 10/078,072

(22) Filed: Feb. 14, 2002

(65) Prior Publication Data

US 2002/0113133 A1 Aug. 22, 2002

(30) Foreign Application Priority Data

Feb. 21, 2001 (JP) ..... P2001-045428
Feb. 21, 2001 (JP) ..... P2001-045429

(51) Int. Cl.[7] ..... G05D 23/00
(52) U.S. Cl. ..... 237/2 B; 62/238.6; 165/140
(58) Field of Search ..... 237/2 B; 236/42, 236/43; 62/238.6, 238.7; 165/140

(56) References Cited

U.S. PATENT DOCUMENTS 4,041,726 A * 8/1977 Mueller et al. ..... 62/238.6
4,332,137 A * 6/1982 Hayes, Jr. ..... 62/151
4,474,018 A * 10/1984 Teagan ..... 237/2 B
4,976,464 A * 12/1990 Swenson ..... 237/2 B
5,313,787 A * 5/1994 Martin ..... 62/222
5,366,152 A * 11/1994 Gossi ..... 237/2 B
5,509,274 A * 4/1996 Lackstrom ..... 237/2 B
5,727,393 A * 3/1998 Mahmoudzadeh ..... 62/156
5,984,198 A * 11/1999 Bennett et al. ..... 165/140
6,085,531 A * 7/2000 Numoto et al. ..... 62/129
6,233,951 B1 * 5/2001 Cardill ..... 237/2 B

* cited by examiner

*Primary Examiner*—Derek S. Boles
(74) *Attorney, Agent, or Firm*—Darby & Darby

(57) ABSTRACT

A heat pump type hot water supply apparatus (10) for heating water by refrigerant heat and stocking the hot water thus achieved including: a heat pump unit (11) having a refrigerant circuit using natural refrigerant, the refrigerant circuit including a compressor (16) for compressing refrigerant, a heat-pump heat exchanger (18) and a refrigerant-water heat exchanger (27) for performing the heat exchange between refrigerant and water to achieve hot water; a hot water supply unit (12) including a hot water supply tank (26) for stocking the hot water achieved by the refrigerant-water heat exchanger (27) of the heat pump unit (11) and supplying the hot water thus stocked; and a water pipe (36) through which the refrigerant-water heat exchanger (27) of the heat pump unit (11) and the hot water supply tank (26) of the hot water supply unit (12) are connected to each other to circulate hot-water/water between the refrigerant-water heat exchanger (27) and said hot water supply tank (26).

9 Claims, 9 Drawing Sheets

HEAT PUMP TYPE HOT WATER SUPPLY APPARATUS

BACKGROUND OF THE INVENTION

1. Field of the Invention

The present invention relates to a heat pump type hot water supply apparatus for heating water by using refrigerant heat and then stocking the hot water thus achieved in a hot-water supply tank.

2. Description of the Related Art

There has been hitherto proposed such a heat pump type hot water apparatus that a heat exchanger for hot water supply heats water by using heat of refrigerant and the hot water thus achieved is stocked in a hot-water supply tank. In general, such a type of hot water supply apparatus is equipped with a heat-pump unit containing a compressor, a heat-pump heat exchanger and a pressure-reducing device, and a hot water unit containing a refrigerant-water heat exchanger for performing the heat exchange between refrigerant and water and a hot-water supply tank for stocking hot water achieved through the heat exchange between refrigerant and water in the refrigerant-water heat exchanger, and the hot water unit and the heat pump unit are connected to each other through a refrigerant pipe.

However, in a case where the heat pump type hot water supply apparatus having the above construction is designed so that the refrigerant pipe through which the hot water unit and the heat pump unit are connected to each other is exposed to the outside, the safety of the heat pump type hot water supply apparatus might be lost if the refrigerant is formed of a refrigerant material containing a large amount of carbon dioxide because the refrigerant pressure of the refrigerant material is higher than that of freon-based refrigerant.

Further, some of heat pump type hot water supply apparatuses as described above have not only a refrigerant-water heat exchanger for hot water supply, but also a refrigerant-water heat exchanger for reheating of hot water or water in a bath tub. In this case, the heat pump unit must be actuated even when it is sufficient to reheat the hot water or water in the bath tub without supplying hot water into the bath tub.

Further, in this type of heat pump hot water supply apparatus, the temperature of hot water at the top portion of the hot-water supply tank rises up, and thus there is used such a method that a hot-water outlet pipe is connected to the top portion of the hot water supply tank to take out hot water at the top portion, the hot water supplied through the hot-water outlet pipe is mixed with water to adjust the temperature of the hot water to a proper value, and then the temperature-adjusted hot water is supplied to users. In this case, if the temperature of the hot water in the hot-water supply tank is high, a large amount of water must be mixed with the hot water, and the mixing of a large amount of water reduces the energy efficiency of the heat pump type hot water supply apparatus.

SUMMARY OF THE INVENTION

The present invention has been implemented in view of the foregoing situation, and has an object to provide a heat pump type hot water supply apparatus which can prevent a high-pressure refrigerant pipe from being exposed to the outside to enhance the safety of the apparatus and enhance the energy efficiency of the heat pump type hot water supply apparatus.

In order to attain the above object, according to the present invention, there is provided a heat pump type hot water supply apparatus for heating water by refrigerant heat and stocking the hot water thus achieved, characterized by comprising: a heat pump unit having a refrigerant circuit using natural refrigerant, the refrigerant circuit including a compressor for compressing refrigerant, a heat-pump heat exchanger and a refrigerant-water heat exchanger for performing the heat exchange between refrigerant and water to achieve hot water; a hot water supply unit including a hot water supply tank for stocking the hot water achieved by the refrigerant-water heat exchanger of the heat pump unit and supplying the hot water thus stocked; and a water pipe through which the refrigerant-water heat exchanger of the heat pump unit and the hot water supply tank of the hot water supply unit are connected to each other to circulate hot-water/water between the refrigerant-water heat exchanger and the hot water supply tank.

In the heat pump type hot water supply apparatus of the present invention, the hot water supply unit further includes hot-water joint control means for controlling the joint of hot water supplied from at least two inner portions of the hot water supply tank which are different in hot-water temperature.

In the heat pump type hot water supply apparatus of the present invention, the hot-water joint control means comprises at least two hot water outlet pipes that extend from the hot water supply tank and join each other at one ends thereof and through which the hot water is supplied from the hot water supply tank to the outside thereof, each of at least two hot water outlet pipes being equipped with an opening/closing valve for allowing/intercepting flow of the hot water therethrough, and a controller for controlling the opening/closing operation of the opening/closing valves of at least two hot water outlet pipes.

In the heat pump type hot water supply apparatus of the present invention, the controller controls the opening/closing operation of the opening/closing valves in accordance with the temperature of the hot water in at least one of at least two inner portions of the hot water supply tank so that hot water having a proper temperature is supplied.

In the heat pump type hot water supply apparatus of the present invention, the hot-water joint control means comprises at least two hot water outlet pipes that extend from the hot water supply tank and join each other at one ends thereof and through which the hot water is supplied from the hot water supply tank to the outside thereof, a mixing valve disposed at the joint position of at least two hot water outlet pipes, the mixing valve controlling the joint degree of the hot water supplied through at least two hot water outlet pipes, and a controller for controlling the mixing operation of the mixing valve.

In the heat pump type hot water supply apparatus of the present invention, the controller controls the mixing valve to adjust the mixing degree of the hot water supplied through at least two hot water outlet pipes in accordance with the temperature of the hot water in at least one of at least two inner portions of the hot water supply tank so that hot water having a proper temperature is supplied.

In the heat pump type hot water supply apparatus of the present invention, the mixing valve comprises a wax valve.

In the heat pump type hot water supply apparatus of the present invention, at least two inner portions of the hot water supply tank includes the top portion of the hot water supply tank and an intermediate portion between the top portion and the bottom portion of the hot water supply tank.

In the heat pump type hot water supply apparatus of the present invention, the hot water supply unit further includes a water—water heat exchanger for performing the heat exchange between the hot water supplied from the hot water supply tank and hot-water/water circulated in a bath tub to reheat the hot-water/water in the bath tub.

In the heat pump type hot water supply apparatus of the present invention, the hot water supply unit includes a mixing control valve for controlling the mixing of tap water and the hot water from the hot water supply tank so that the temperature of the hot water from the hot water supply unit is set to a proper temperature.

DETAILED DESCRIPTION OF THE PREFERRED EMBODIMENTS

Preferred embodiments according to the present invention will be described hereunder with reference to the accompanying drawings. In the following embodiments, it is assumed that natural refrigerant such as refrigerant containing a large amount of carbon dioxide or the like is used. In the case of refrigerant containing a large amount of carbon dioxide, the pressure of the refrigerant is generally higher than that of freon-based refrigerant.

Figure 1:
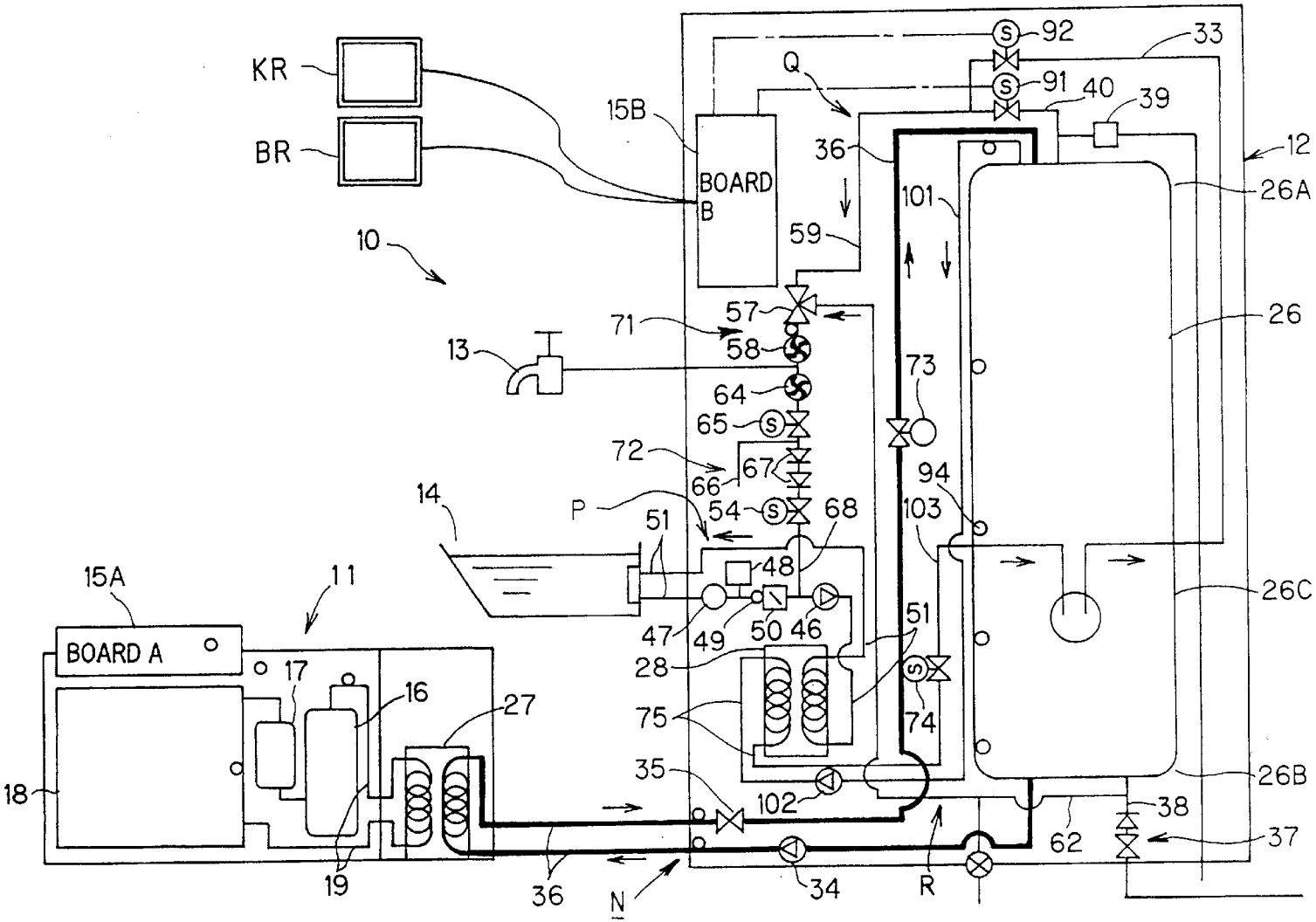
FIG. 1 is a refrigerant circuit diagram showing a first embodiment of a heat pump type hot water supply apparatus according to the present invention when water in a hot-water supply tank is heated, and hot water thus achieved is stocked in the hot-water supply tank.
Figure 1B:
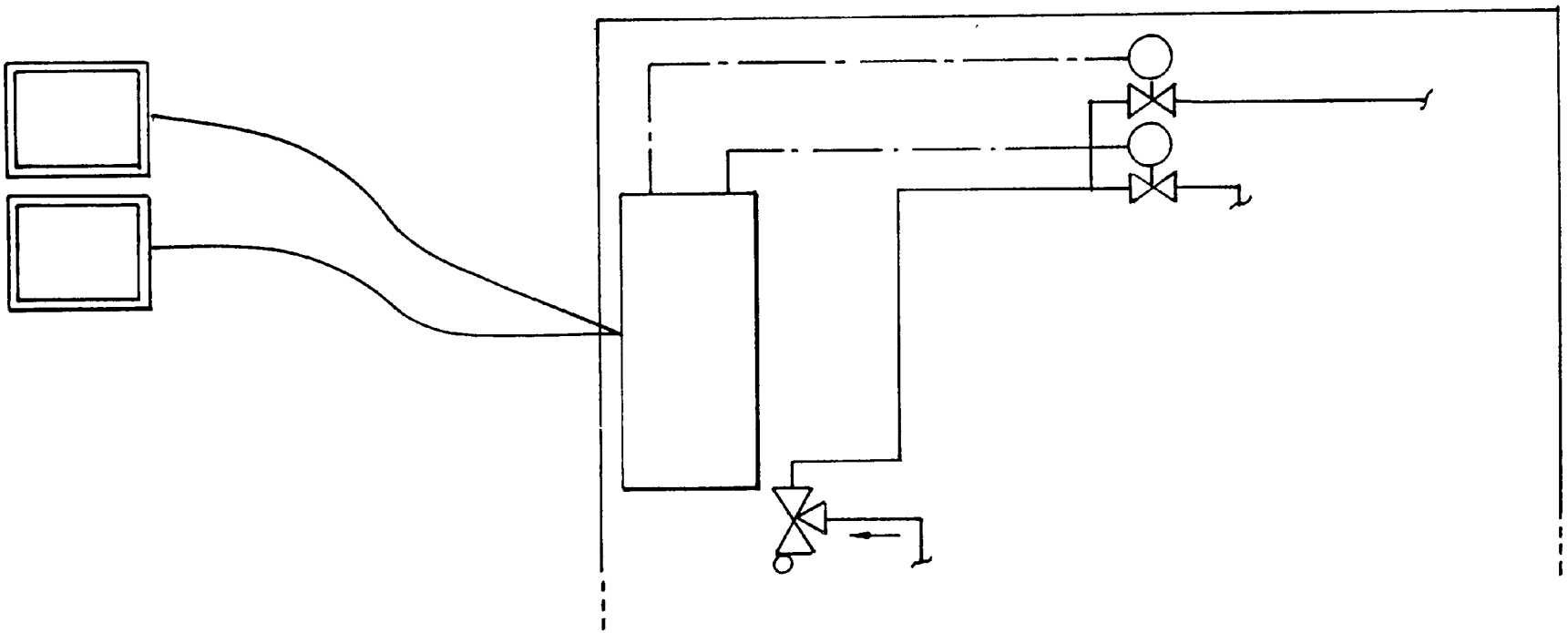
FIG. 1*b* is an exploded view of the hot-water control detailed in the refrigerant circuit diagram of FIG. 1.

FIG. 1 shows a first embodiment of a heat pump type hot water supply apparatus according to the present invention, and more specifically, FIG. 1 is a refrigerant circuit diagram of the heat pump type hot water supply apparatus when water in a hot-water supply tank is heated and hot water thus achieved is stocked in the hot-water supply tank.

As shown in FIG. 1, the heat pump type hot water supply apparatus 10 includes a heat pump unit 11, a hot water unit 12, a tap (water tap) 13, a bath tub 14 and controllers 15A and 15B.

The heat pump unit 11 includes a compressor 16, a heat exchanger for hot water supply (refrigerant-water heat exchanger) 27, a heat-pump heat exchanger 18 and an accumulator 17, which are successively connected to one another through a refrigerant pipe 19 in this order. The compressor 16 functions to compress refrigerant. The heat exchanger 27 for hot water supply heats hot water or water by using the heat of refrigerant discharged from the compressor 16.

The hot water unit 12 includes a hot-water supply tank 26, a heat exchanger for bath (water—water heat exchanger) 28, a tap hot-water supply line 71, a bath hot-water pouring line 72, etc.

The hot-water supply tank 26 is used to stock hot water which is heated by using refrigerant heat in the hot-water heat exchanger 27. The hot-water supply tank 26 and the hot-water heat exchanger 27 are connected to each other in a loop style through a water pipe 36 for hot water supply which is equipped with a hot-water circulating pump 34, a flow rate adjusting valve 35 and a first change-over electromagnetic valve 73, thereby forming a water circulating circuit N for hot water supply through which water is circulated as indicated by a heavy line in FIG. 1 when the first change-over electromagnetic valve 73 is operated to be opened.

When refrigerant containing a large amount of carbon dioxide is used, the refrigerant pressure thereof is higher than that of freon-based refrigerant as described above. Therefore, the temperature of hot water in the hot water heat exchanger 27 rises up to about 90° C.

The heat pump unit 11 and the hot water unit 12 are connected to each other in the loop style by the water pipe 36 for hot water supply. Therefore, unlike the conventional heat pump type hot water supply apparatus, the high-pressure refrigerant pipe (for example, refrigerant pipe 19) is not exposed to the outside and the safety of the heat pump type hot water supply apparatus can be enhanced.

A first tap water pipe 38 having a pressure-reduced check valve 37 disposed therein is connected to the bottom portion 26B of the hot-water supply tank 26 to supply tap water into the hot-water supply tank 26 at all times. Accordingly, the pressure of the tap water acts in the hot-water supply tank 26 at all times.

In this embodiment, a top portion hot-water outlet pipe 40 having a first opening/closing valve 91 is connected to the top portion 26A of the hot-water supply tank 26, and an intermediate hot-water outlet pipe 33 having a second opening/closing valve 92 is connected to an intermediate portion (for example, a substantially midpoint portion) and will be referred to as) between the top portion 26A and the bottom portion 26B of the hot-water supply tank 26. The first and second opening/closing valves 91, 92 connected to the pipes 40, 33 respectively are selectively subjected to opening/closing control by the controller 15B in accordance with the hot water temperature detected by a temperature sensor 94 disposed at the intermediate portion 26C of the hot-water supply tank 26.

When the hot-water circulating pump 34 is actuated to supply water at the bottom portion 26B of the hot-water supply tank 26 to the hot-water heat exchanger 27, the hot-water heat exchanger 27 performs the heat exchange between the water thus supplied and high-temperature refrigerant gas discharged from the compressor 16 of the heat pump unit 11 to heat the water by using the heat of the refrigerant gas. When the first change-over electromagnetic valve 73 is controlled to be opened, the hot water (or water)

thus heated is subjected to flow rate adjustment by the flow rate adjusting valve 35 and then fed to the top portion 26A of the hot-water supply tank 26, whereby the hot water whose upper limit temperature is equal to about 90° C. can be stocked in the hot-water supply tank 26.

The top portion 26A of the hot-water supply tank 26 is further equipped with a pressure releasing valve 39. The pressure releasing valve 39 is used to release pressure when hot water or water is excessively heated and the pressure in the hot-water supply tank 26 is excessively increased.

The bath heat exchanger 28 is a water—water heat exchanger through which the hot water in the hot-water supply tank 26 is circulated to reheat hot water in the bath tub 14. The hot water in the hot-water supply tank 26 is pumped out by actuating a pump 102 in a circulating pipe 101 extending out from the top portion 26A. The hot water thus pumped out is passed through the circulating pipe 101, and led to the bath heat exchanger 28 to heat (reheat) the hot water or water in the bath tub 14. Thereafter, it is passed through a second change-over electromagnetic valve 74 and a returning pipe 103 and then returned to the intermediate portion 26C between the top portion 26A and the bottom portion 26B of the hot-water supply tank 26.

That is, the bath heat exchanger 28 is designed to perform the heat exchange between the hot-water (water) flowing in a water introducing pipe 75 for introducing the hot water in the hot-water supply tank 26 and the hot-water (water) flowing in a first bath water pipe 51 for introducing the hot water or water in the bath tub 14 through the contact between the water introducing pipe 75 and the first bath water pipe 51. The water introducing pipe 75 and the first bath water pipe 51 are designed in a flat tubular shape to increase the contact area therebetween.

The first bath water pipe 51 through which the bath heat exchanger 28 and the bath tub 14 intercommunicate with each other is equipped with a circulating pump 46 for bath, a filter 47, a water level sensor 48, a thermistor 49 and a flow switch 50.

A water circulating circuit P for bath through which hot water or water is circulated between the bath heat exchanger 28 and the bath tub 14 is constructed by the first bath water pipe 51.

The water level sensor 48 intercommunicates with the bath tub 14 through the first bath water pipe 51, and thus it detects the water level of hot water or water in the bath tub 14. When hot water or water is circulated in the bath water circulating circuit P, the thermistor 49 detects the temperature of the hot water/water to indirectly detect the temperature of the hot water/water in the bath tub 14. The flow switch 50 detects that hot water or water circulates in the bath water circulating circuit P. Further, the filter 47 filters the circulating hot water/water together with a filter 56 disposed in the bath tub 14.

Figure 4:
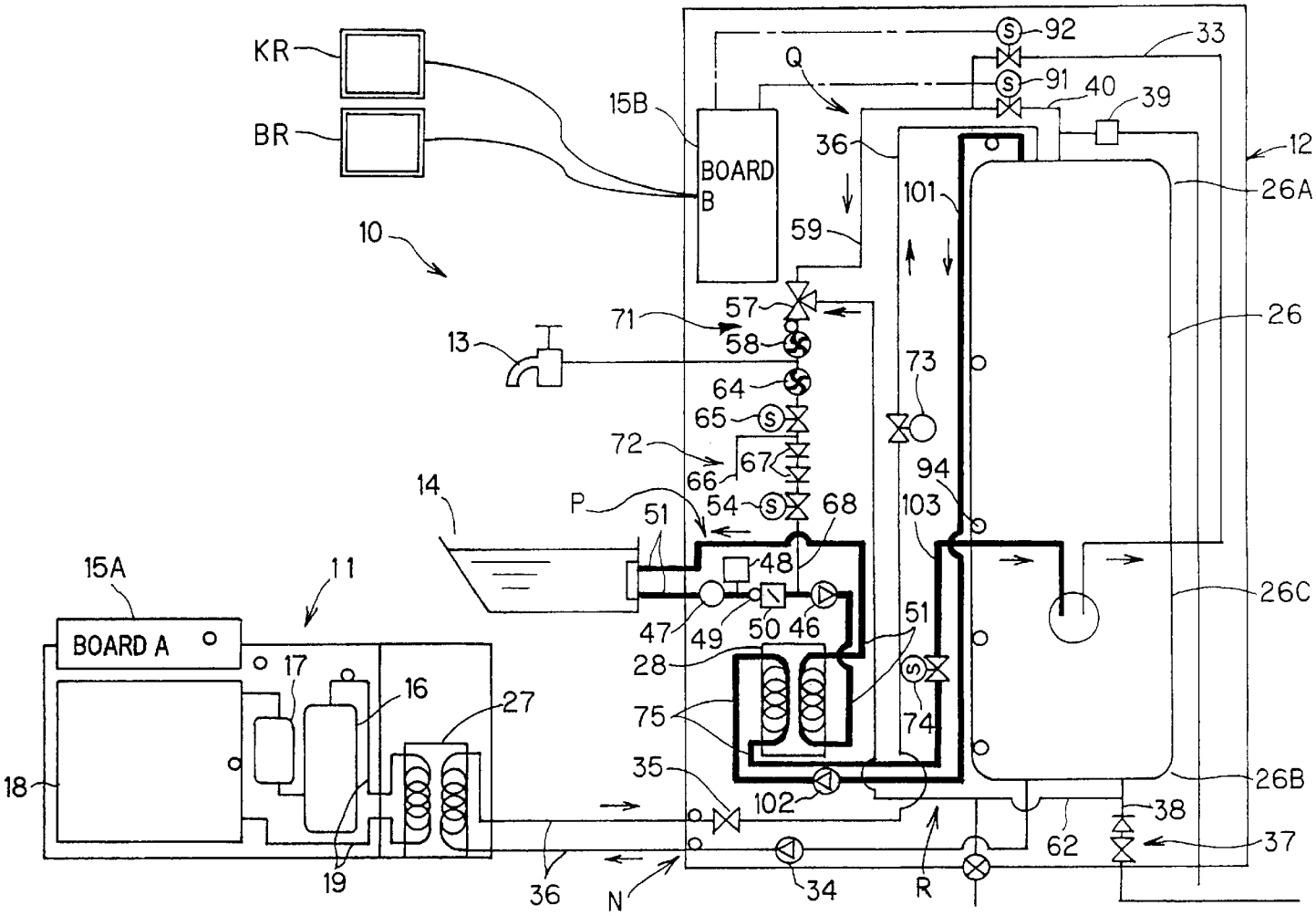
FIG. 4 is a refrigerant circuit diagram of the heat pump type hot water supply apparatus shown in FIG. 1 when water or hot water in the bath tub is heated (reheated) to keep the temperature of the hot water.
Figure 5:
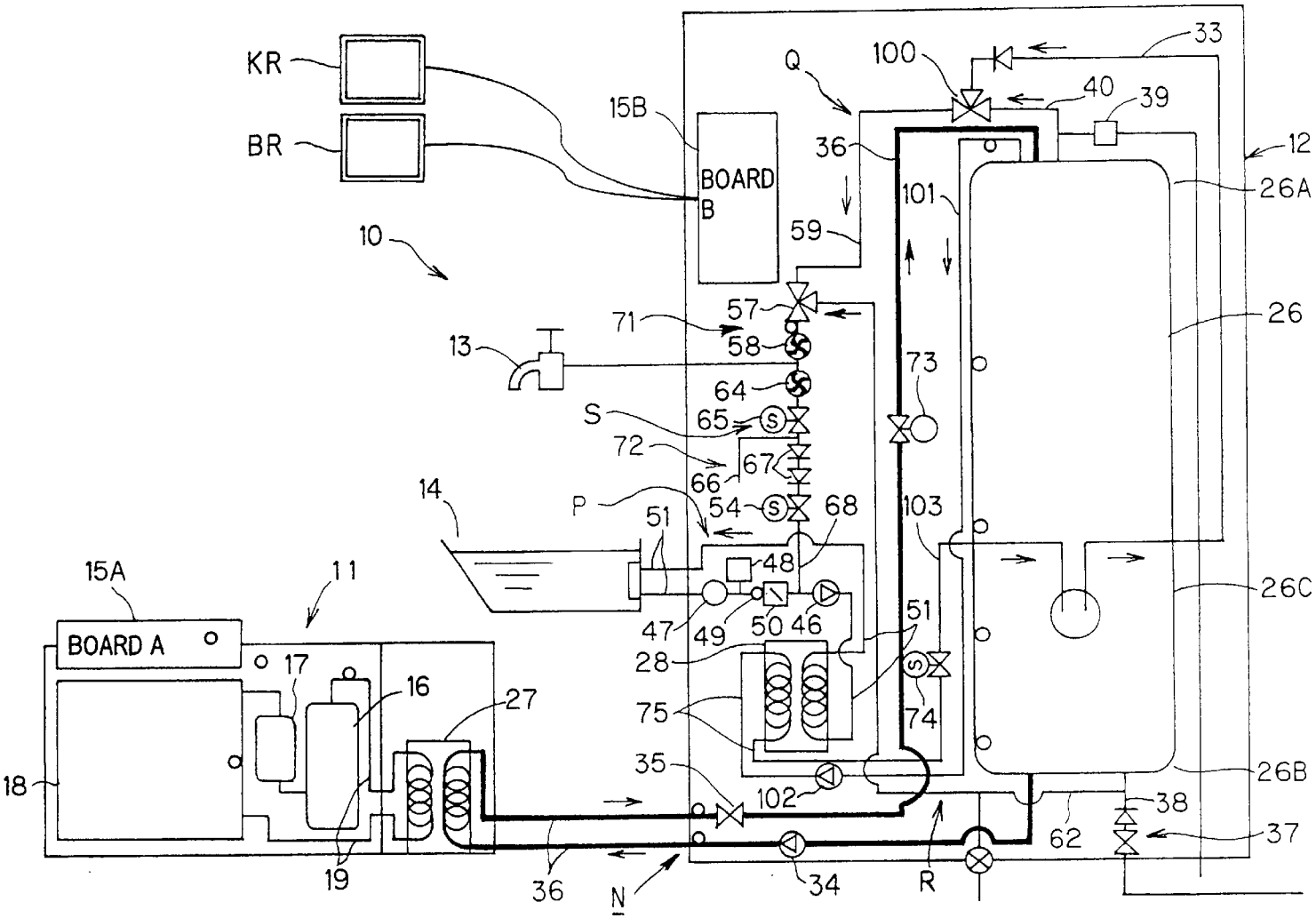
FIG. 5 is a refrigerant circuit diagram showing a second embodiment of the heat pump type hot water supply apparatus according to the present invention when water in a hot-water supply tank is heated, and hot water thus achieved is stocked in the hot-water supply tank.

When the hot-water pouring into the bath tub 14 as described later is carried out to fill hot water into the bath tub 14 and then the hot water in the bath tub 14 is reheated, the circulating pump 102 and the bath circulating pump 46 are actuated. At this time, as indicated by a heavy line of FIG. 4, both the hot water in the hot-water supply tank 26 and the hot water in the bath tub 14 are made to flow into the bath heat exchanger 28, and subjected to the heat exchange, whereby the hot water in the bath tub 14 is reheated by the hot water in the hot-water supply tank 26. The temperature of the hot water working in the bath heat exchanger 28 is reduced to about 50° C. through the heat exchange, and then the hot water flows through the water pipe 103 into the intermediate portion 26C of the hot water supply tank 26.

Figure 2:
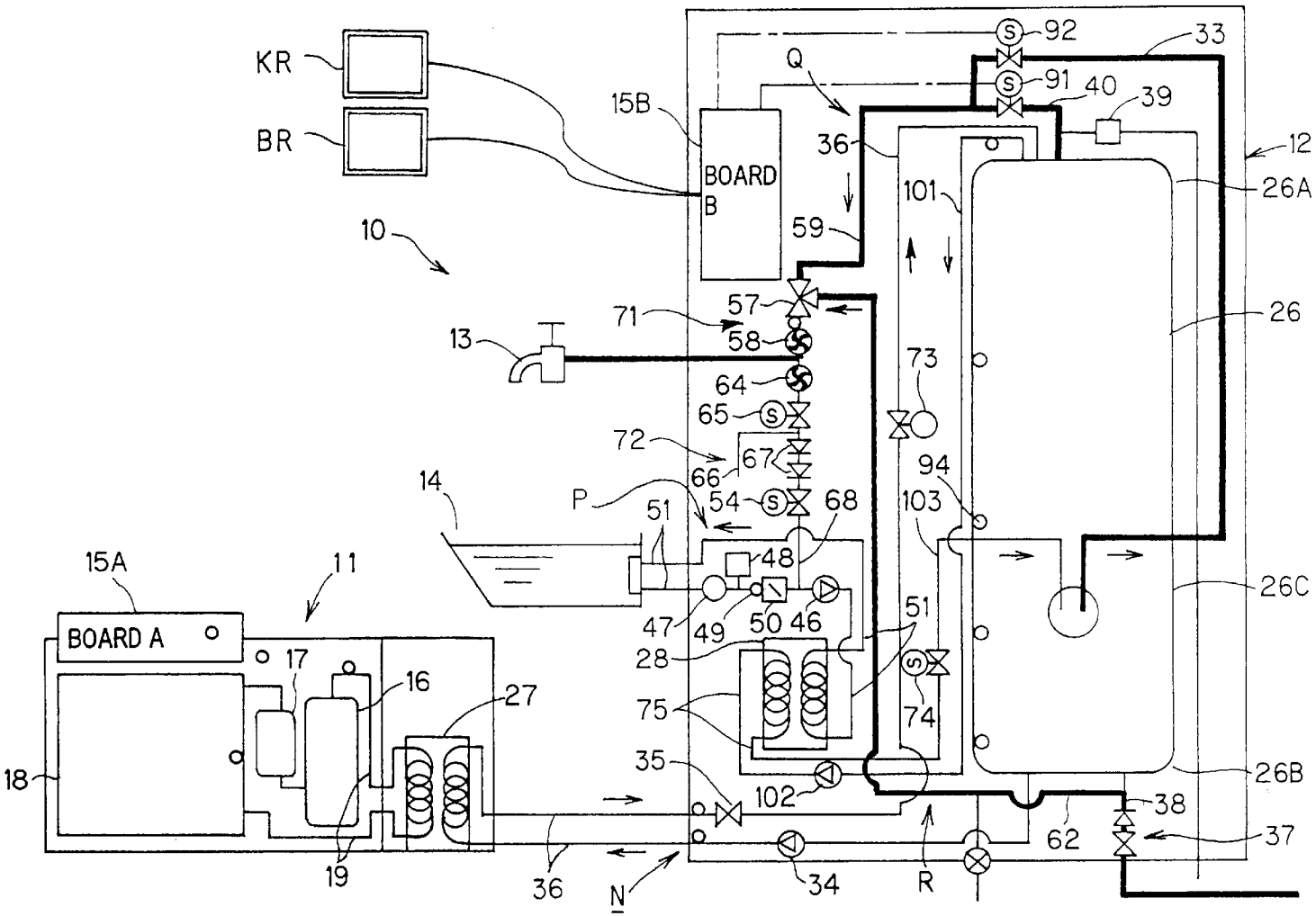
FIG. 2 is a refrigerant circuit diagram of the heat pump type hot water supply apparatus shown in FIG. 1 when hot water is supplied to a tap.

The tap hot-water supply line 71 comprises a hot-water pipe 59, a mixing control valve 57 and a flow sensor 58 as indicated by a heavy line Q of FIG. 2. Since the water pressure of the tap water acts on the hot water in the hot water supply tank 26 through the first tap water pipe 38, the hot water in the hot water supply tank 26 can be supplied to the tap 13 by opening the tap 13.

The flow sensor 58 detects the flow rate of the hot water flowing in the hot water pipe 59. The mixing control valve 57 is connected through a second tap water pipe 62 to the downstream side of the pressure-reduced check valve 37 in the first tap water pipe 38 as indicated by the heavy line of FIG. 2.

By the opening/closing control operation of the mixing control valve 57, the hot water from the hot water supply pipe 59 and the tap water from the second tap water pipe 62 are mixed with each other so that the temperature of the hot water to be supplied from the tap is adjusted to about 60° C. or less, for example, to 42° C.

Figure 3:
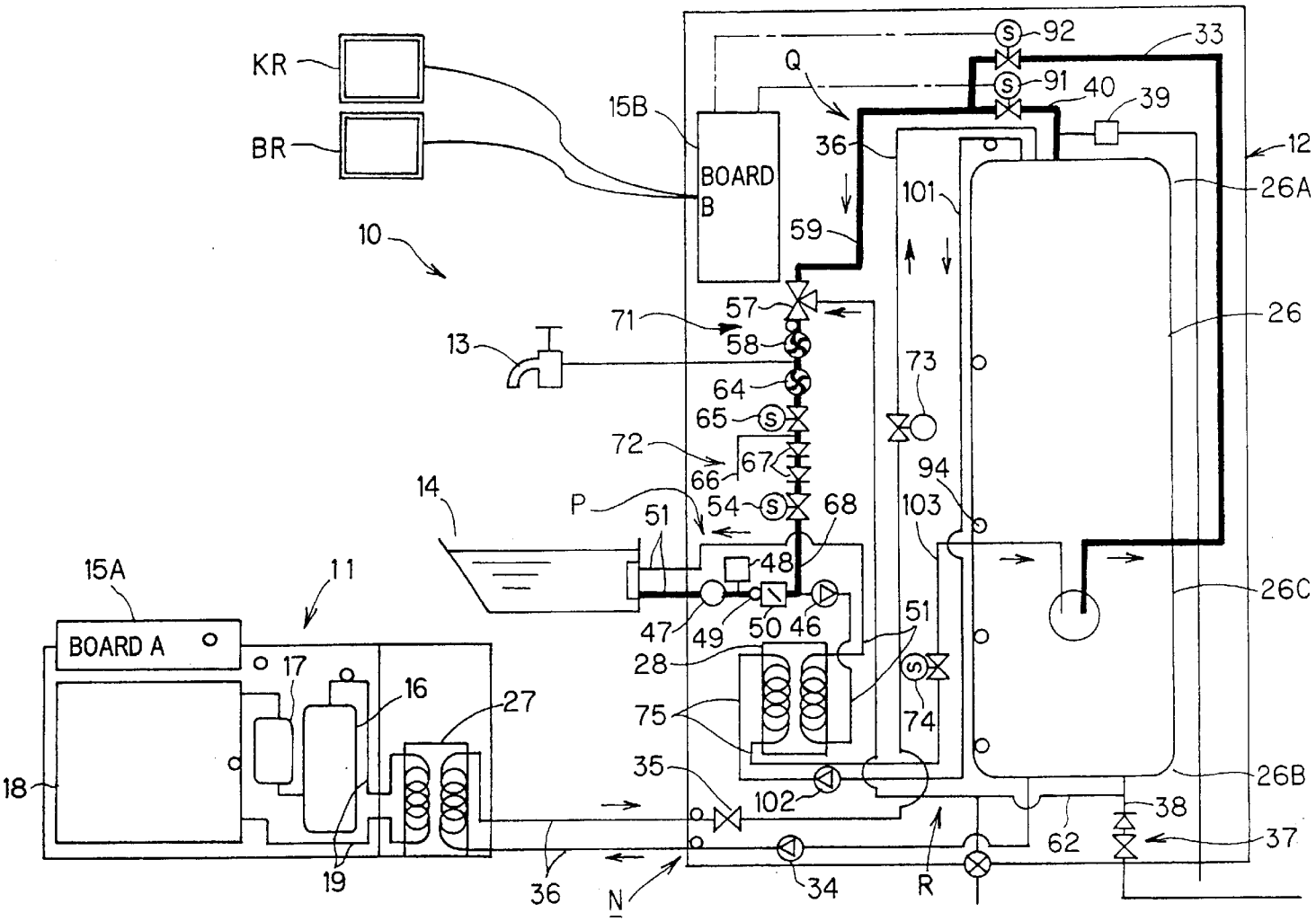
FIG. 3 is a refrigerant circuit diagram of the heat pump type hot water supply apparatus shown in FIG. 1 when hot water is put into a bath tub.

As indicated by a heavy line S of FIG. 3, a hot-water supply line 72 for bath is constructed by connecting the downstream side of the flow sensor 58 in the hot water supply pipe 59 through the second bath water pipe 68 to the intermediate portion between the bath circulating pump 46 and the flow switch 50, whereby the hot water in the hot water supply tank 26 can be poured into the bath tub 14. A flow sensor 64, a hot water pouring electromagnetic valve 65, a relief means 66, a check valve 67 and an electromagnetic valve 54 are successively disposed in this order from the side of the hot water supply pipe 59 in the second bath water pipe 68.

The flow sensor 64 detects the flow rate of hot water flowing in the second bath water pipe 68. When excessively-heated hot water flows into the second bath water pipe 68, the relief means 66 and the check valve 67 serve to release the pressure of the hot water. The electromagnetic valve 54 is opened when the hot water is poured into the bath tub 14, and closed when the hot water in the bath tub 14 is reheated.

When the hot water pouring electromagnetic valves 65, 54 are opened under the state that the bath circulating pump 46 is stopped, as indicated by the heavy line S of FIG. 3, the hot water in the hot water supply tank 26 flows through a part of the hot water supply pipe 59 and the second bath water pipe 68 into the first bath water pipe 51, and then it is passed through the flow switch 50, the thermistor 49, the water level sensor 48 and the filter 47 in the first bath water pipe 51 and poured into the bath tub 14.

At the stage that it is detected by the water level sensor 48 that a proper amount of hot water is filled from the hot water supply tank 26 into the bath tub 14, the hot water pouring electromagnetic valves 65, 54 are closed. Thereafter, when it is detected by the thermistor 49 that the temperature of the hot water in the bath tub 14 is reduced to a proper temperature or less, the hot water or water in the bath tub 14 is heated (reheated) as described above, so that the temperature of the hot water in the bath tub 14 is kept to the proper value.

The operation of pouring a proper amount of hot water at a proper temperature from the hot water supply tank 26 into the bath tub 14 and then heating (reheating) the hot water in the bath tub 14 for a required time so that the temperature of the hot water is kept to a proper value is referred to as "bath automatic operation".

Since this embodiment has the refrigerant circuit using natural refrigerant, the temperature of hot water stocked in the hot water supply tank 26 rises up to a higher temperature (about 90° C.) than that in the refrigerant circuit using freon-based refrigerant. Accordingly, by circulating the hot water in the hot water supply tank 26, the hot water in the bath tub 14 can be reheated by the hot water thus circulated. Therefore, when the hot water or water in the bath tub is reheated without supplying hot water, the heat pump unit 11 is not needed to be actuated, so that the energy efficiency can be enhanced.

The controller 15A is disposed in the heat pump unit 11 to control the operation (containing the capacity control) and stop of the compressor 16. The controller 15B is disposed in the hot water supply unit 12 to control the actuation or stop of the circulating pump 34 for hot water supply and the circulating pump 46 for bath, the opening/closing operation of the first change-over electromagnetic valve 73, the second change-over electromagnetic valve 74 and the hot water pouring electromagnetic valves 65, 54, the opening degrees of the flow rate adjusting valve 35 and the mixing control valve 57, etc. The controller 15B is connected to the controller 15A of the heat pump unit 11 through a communication line (not shown) to perform interactive communications with the controller 15A, and also connected to remote controllers (kitchen remote controller KR and bath remote controller BR) in a wired or wireless style.

In this embodiment, the top portion hot-water outlet pipe 40 having the first opening/closing valve 91 is connected to the top portion 26A of the hot water supply tank 26, and the intermediate portion hot-water outlet pipe 33 having the second opening/closing valve 92 is connected to the substantially intermediate portion 26C between the top portion 26A and the bottom portion 26B of the hot water supply tank 26. The first and second opening/closing valves 91, 92 connected to the pipes 40, 33 respectively are subjected to the opening/closing control through the controller 15B in accordance with the hot-water temperature detected by the temperature sensor 94 disposed at the intermediate portion 26C of the hot water supply tank 26.

For example, if the hot-water temperature detected by the temperature sensor 94 is equal to about 50° C., the hot-water temperature is approximately near to the required temperature at the tap 13. In this case, the first opening/closing valve 91 is closed and the second opening/closing valve 92 is opened, so that the hot water at the intermediate portion 26C can be taken out from the tap 13.

In this case, by controlling the opening degree of the mixing control valve 57, the hot water from the hot water pipe 59 and the tap water from the second tap water pipe 62 are mixed with each other so that the temperature of the hot water to be supplied from the tap 13 is adjusted to a proper value (for example, 42° C.). An electric valve using a stepping motor or the like is used as the mixing control valve 57 to maintain high mixing precision.

When the temperature of the hot water at the intermediate portion 26*c* is lower than that required for the tap 13, the second opening/closing valve 92 is closed, and the first opening/closing valve 91 is opened, whereby the hot water at the top portion 26A is taken out. In this case, by controlling the opening degree of the mixing control valve 57, the hot water from the hot water pipe 59 and the tap water from the second tap water pipe 62 are also mixed with each other so that the temperature of the hot water to be supplied from the tap 13 is adjusted to a proper value (for example, 42° C.).

According to this embodiment, when the hot water in the hot water supply tank 26 is used, the opening/closing operation of the first and second opening/closing valves 91, 92 is controlled in accordance with the temperature of the hot water at the intermediate portion 26C of the hot water supply tank 26, so that hot water whose temperature is near to the hot-water temperature required for the tap 13, the bath tub 14 or the like can be taken out. Therefore, waste of energy can be prevented and the energy efficiency of the hot water supply apparatus 10 can be enhanced.

Next, a second embodiment of the hot water supply apparatus in which the temperature of hot water to be supplied to the tap 13, the bath tub 14, etc. can be more finely controlled with no tap water will be described with reference to FIGS. 5 to 8. The hot water supply apparatus of the second embodiment has substantially the same construction and operation as the first embodiment shown in FIGS. 1 to 4 except that a mixing valve 100 is used in place of the first and second opening/closing valves 91, 92 of the first embodiment. Accordingly, the same elements as those of FIGS. 1 to 4 are represented by the same reference numerals, and only the differences between the first and second embodiments will be described with omitting the duplicative description.

In the second embodiment, an automatically-adjustable mixing valve 100 mixes the hot water from the top portion 26A with the hot water from the intermediate portion 26C of the hot water supply tank 26 (the mixing ratio of the hot water from the top portion 26A and the hot water from the intermediate portion 26C may be freely and automatically adjustable) is disposed at the joint portion between the intermediate portion hot-water outlet pipe 33 and the top portion hot-water outlet pipe 40 as shown in FIGS. 5 to 8. Therefore, when the temperature of the hot water at the intermediate portion 26C approximately approaches to the required temperature for the tap 13, the bath tub 14 or the like, the mixing valve 100 is controlled to stop the mixing of the hot water from the top portion 26A so that the hot water at the intermediate portion 26C can be directly taken out from the tap 13 through the mixing valve 100.

When the temperature of the hot water at the intermediate portion 26C is low, the mixing valve 100 mixes a larger amount of high-temperature hot water from the top portion 26A with the hot water from the intermediate portion 26C and then feeds out the mixed hot water to the joint pipe 59. On the other hand, when the temperature of the hot water at the intermediate portion 26C is high, the mixing valve 100 feeds the hot water from the intermediate portion 26C to the joint pipe 59 while the hot water from the top portion 26A is hardly mixed with the hot water from the intermediate portion 26C.

Figure 6:
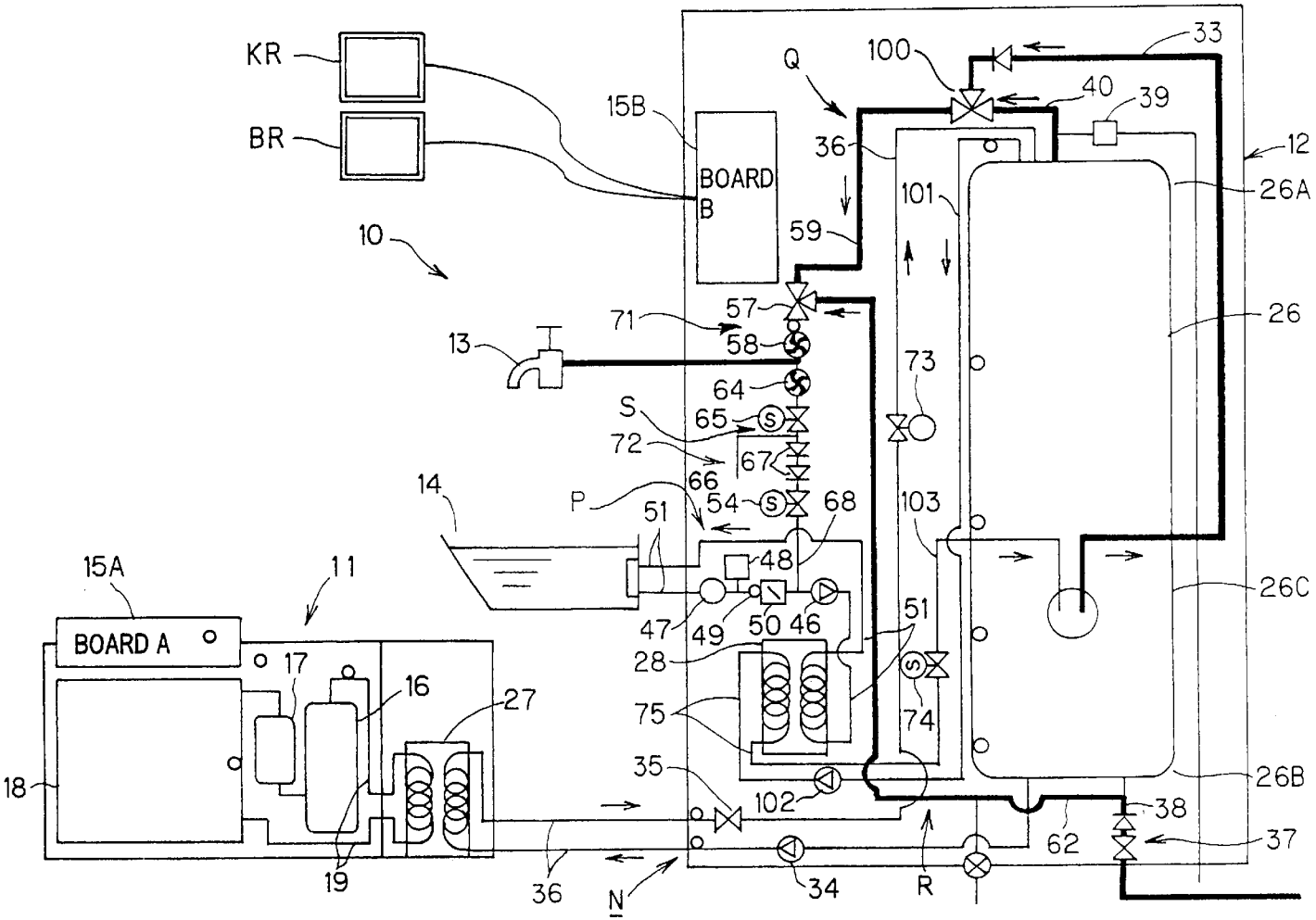
FIG. 6 is a refrigerant circuit diagram of the heat pump type hot water supply apparatus shown in FIG. 5 when hot water is supplied to a tap.
Figure 7:
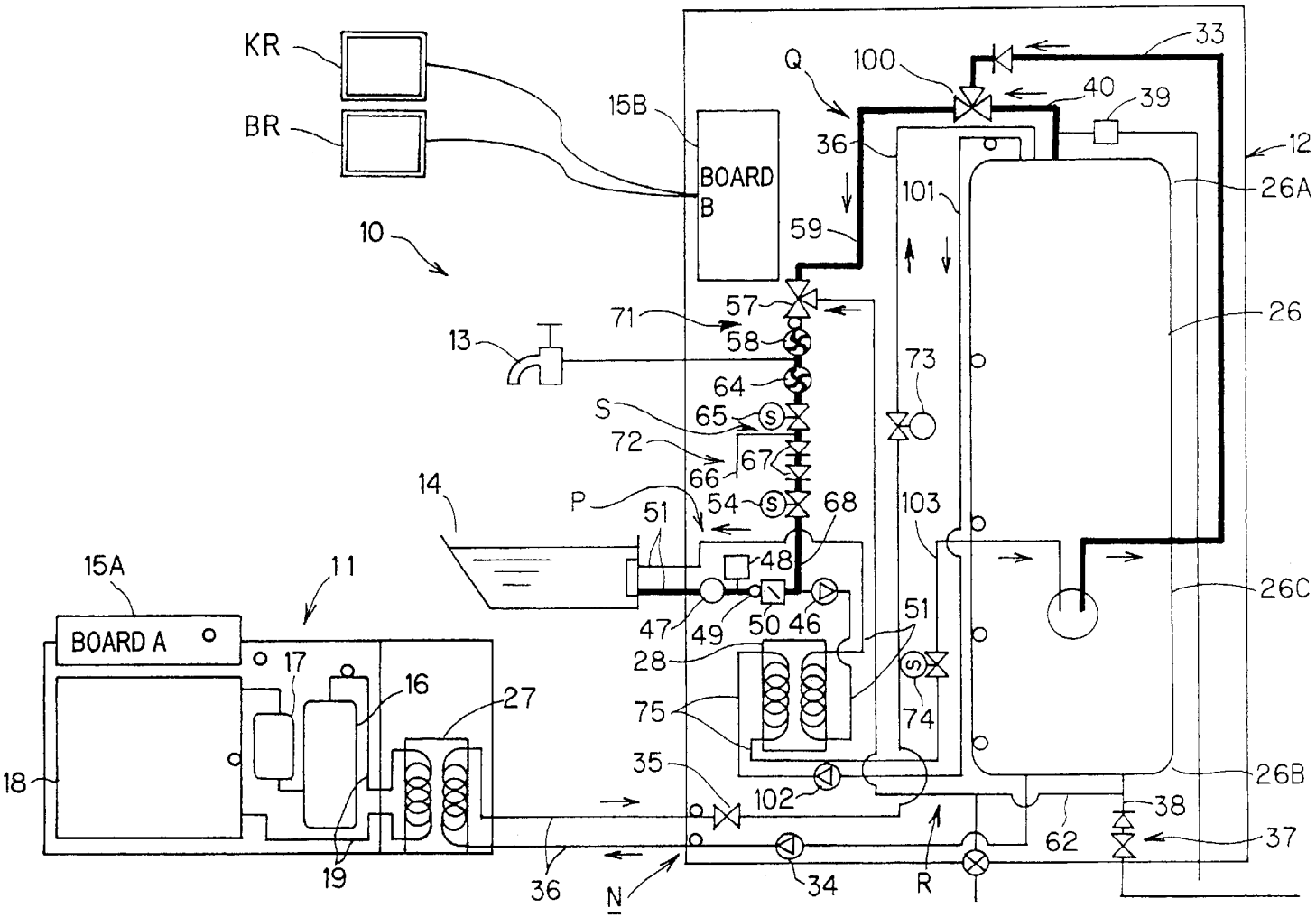
FIG. 7 is a refrigerant circuit diagram of the heat pump type hot water supply apparatus shown in FIG. 5 when hot water is put into a bath tub.

If the temperature of the hot water fed out from the mixing valve 100 is above the required temperature of the hot water at the tap 13, the bath tub 14 or the like, the hot water from the hot water supply pipe 59 is mixed with the tap water from the second tap water pipe 62 by controlling the opening degree of the mixing control valve 57 so that the temperature of the hot water to be supplied from the tap 13, the bath tub 14 is adjusted to a proper value (for example, 42° C.) as shown in FIGS. 6, 7.

Accordingly, the hot water in the hot water supply tank 26 can be directly fed out to the tap 13, the bath tub 14, etc. without lowering the temperature of the hot water from the hot water supply tank 26 with tap water, so that waste of energy can be prevented and the energy efficiency of the hot water supply apparatus 10 can be enhanced.

In this case, a wax valve may be used as the mixing valve 100, and in this case the cost can be reduced.

If the mixing ratio of the hot water from the top portion 26A and the hot water from the intermediate portion 26C is more finely adjusted in accordance with the temperature of the intermediate portion 26C detected by the temperature sensor 94, the temperature of the hot water to be supplied to the tap 13, the bath tub 14, etc. can be more finely adjusted. Further, if the mixing ratio of the hot water fed through the hot water supply pipe 59 and the tap water from the second tap water pipe 62 is more finely adjustable, the temperature of the hot water to be supplied to the tap 13, the bath tub 14, etc. can be further more finely adjusted. Further, as described above, if an electric valve using a stepping motor or the like is used as the mixing control valve 57, the mixing precision can be kept high.

Figure 8:
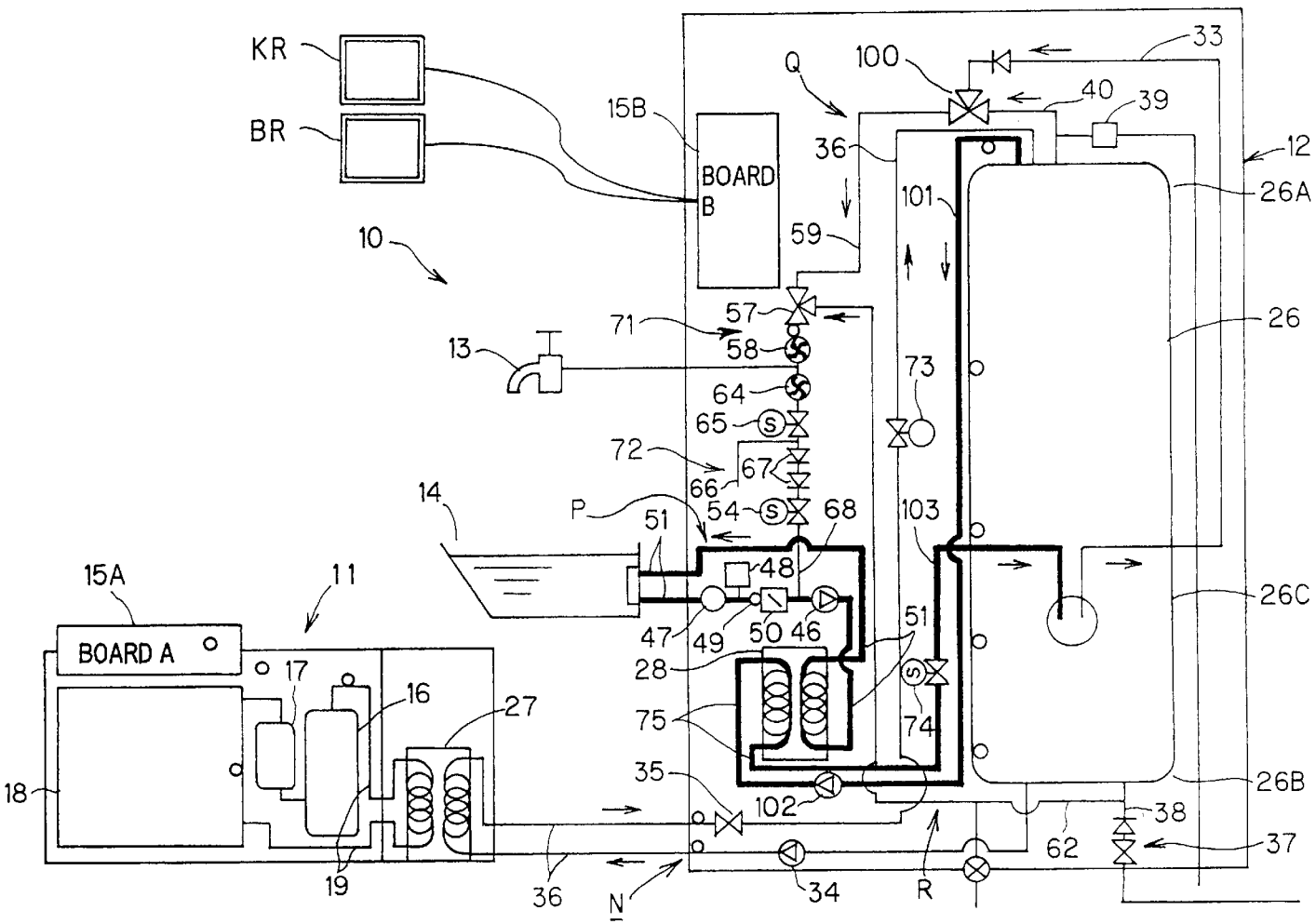
FIG. 8 is a refrigerant circuit diagram of the heat pump type hot water supply apparatus shown in FIG. 5 when water or hot water in the bath tub is heated (reheated) to keep the temperature of the hot water.

Further, when the hot water in the bath tub 14 is reheated, the mixing valve 100 may be controlled to stop the supply of the hot water from both the top portion 26A and the intermediate portion 26C as shown in FIG. 8.

The present invention is not limited to the above first and second embodiments, and various modifications may be made to the first and second embodiments without departing from the subject matter of the present invention.

As described above, the above-described embodiments have the following effect.

The heat exchanger 27 for hot water supply which can heat water by using refrigerant heat and stock the water thus heated (hot water) into the hot water supply tank 26 is disposed in the heat pump unit 11 having the compressor 16 for compressing refrigerant, the hot water supply tank 26 is disposed in the hot water supply unit 12, and the heat exchanger 28 for bath heats the hot water or water in the bath tub 14 by using the heat of the hot water from the heat exchanger 27 for hot water supply to keep the temperature of the hot water. Therefore, the refrigerant pipe 19 in which high-pressure refrigerant flows is disposed only in the heat pump unit 11, and it is not disposed between the heat pump unit 11 and the hot water supply unit 12, so that the high-pressure refrigerant pipe can be prevented from being exposed to the outside, and the safety of the heat pump type hot water supply apparatus 10 can be enhanced.

The heat exchanger 28 for bath can perform the heat exchange of hot water (or water) flowing in both the water introducing pipe 75 for introducing the hot water in the hot water supply tank 26 and the first water pipe 51 for bath for introducing the hot water (or water) in the bath tub 14 through the contact between the contact portions thereof in the heat exchanger 28 for bath. Therefore, the heat pump unit 11 is not needed to be actuated when the hot water in the bath tub is reheated, so that the energy efficiency can be enhanced. Further, even when one of the pipes (the water introducing pipe 75 and the first water pipe 51 for bath) is damaged, the other pipe is not influenced by the damage of the former pipe. For example, even when the first water pipe 51 for bath is damaged, for example, polluted hot water or water in the first water pipe 51 for bath is not contaminated into hot water or water in the water introducing pipe 75. Accordingly, since the polluted hot water is prevented from flowing through the first water pipe 51 for bath into the hot water supply tank 26, the hot water or water in the hot water supply tank 26 can be kept clean at all times.

Since the refrigerant circuit using natural refrigerant is equipped, the temperature of the hot water stocked in the hot water supply tank 26 rises up to a higher temperature (about 90° C.) as compared with that in the refrigerant circuit using freon-based refrigerant. Accordingly, the temperature of the hot water at the substantially intermediate portion 26C of the hot water supply tank 26 is also frequently kept to about 50° C. If so, the hot water at the intermediate portion 26C can be directly used because the temperature of the hot water required for the tap 13 is frequently equal to about 42 to 43° C.

In the above embodiments, the hot water to be joined to the hot water supplied from the top portion 26A of the hot water supply tank 26 is supplied from only one position (the intermediate portion 26C of the hot water supply tank 26) through only one outlet pipe (the intermediate portion hot-water outlet pipe 33). However, the hot water to be joined may be supplied from any number of intermediate positions between the top portion 26A and the bottom portion 26C through any number of intermediate portion hot-water outlet pipes. If plural outlet pipes are provided, each pipe is equipped with an opening/closing valve connected to the controller 15B (in the first embodiment), or connected to the mixing valve 100. According to the position from which the hot water to be joined is supplied, the temperature of the hot water to be supplied to the tap 13, the bath tub 14, etc. can be more finely adjusted.

According to the present invention, the refrigerant circuit using natural refrigerant is equipped, and thus the temperature of hot water stocked in the hot water supply tank rises up to a higher temperature than the refrigerant circuit using freon-based refrigerant. Accordingly, the temperature of hot water to be supplied through the intermediate hot water outlet pipe is very high. However, the opening/closing operation of the first and second opening valves or the mixing operation of the mixing valve is controlled in accordance with the temperature of hot water at the intermediate portion of the hot water supply tank to select one of the hot water supplied through the intermediate portion hot water outlet pipe and the hot water supplied through the top portion hot water outlet pile or to adjust the mixing ratio of the former hot water and the latter hot water, so that it is avoided to mix unnecessary tap water with hot water and thus the energy efficiency of the hot water supply apparatus can be enhanced.

What is claimed is:

1. A heat pump type hot water supply apparatus for heating water by refrigerant heat and stocking the hot water thus achieved, comprising:

a heat pump unit having a refrigerant circuit using natural refrigerant, said refrigerant circuit including a compressor for compressing refrigerant, a heat pump heat exchanger and a refrigerant-water heat exchanger for performing the heat exchange between refrigerant and water to achieve hot water;

a hot water supply unit including a hot water supply tank for stocking the hot water achieved by said refrigerant water heat exchanger of said heat pump unit;

a water pipe through which said refrigerant-water heat exchanger of said heat pump unit and said hot water supply tank of said hot water supply unit are connected to each other to circulate hot water/water between said refrigerant water heat exchanger and said hot water supply tank; and a hot-water control which mixes hot water elements supplied by the two inner portions of the hot water supply tank, each hot water element of different temperature, with a second water source, thereby adjusts the overall temperature of said mixture to a temperature ready for end user use and which supplies said mixture to an output for said end user use.

2. The heat pump type hot water supply apparatus as in claim 1, wherein said hot-water control further comprises at least two opening/closing valves for controlling a mixture of said hot water elements, a mixing valve for controlling a mixture of said second water source and said mixed hot water elements, and a controller for controlling said opening/closing valves and said mixing valve.

3. The heat pump type hot water supply apparatus as claimed in claim 2, wherein said said hot water supply unit further comprises at least two hot water outlet pipes extending from said hot water supply tank and joining each other at one ends thereof and through which the hot water elements are supplied from said hot water supply tank to the outside thereof, each of said opening/closing valves are disposed in said hot water outlet pipes.

4. The heat pump type hot water supply apparatus as claimed in claim 3, wherein said hot water control controls the opening/closing operation of said opening/closing valves in accordance with the temperature of the hot water elements in at least one of said two inner portions of said hot water supply tank so that hot water having a proper temperature is supplied.

5. The heat pump type hot water supply apparatus as claimed in claim 2, wherein said controller controls said mixing valve to adjust the mixing degree of the hot water supplied through said at least two hot water outlet pipes in accordance with the temperature of the hot water in at least one of said at least two inner portions of said hot water supply tank so that hot water having a proper temperature is supplied.

6. The heat pump type hot water supply apparatus as claimed in claim 2, wherein said mixing valve comprises a wax valve.

7. The heat pump type hot water supply apparatus as claimed in 2, further comprising a water pipe through which said second water source is supplied, wherein said mixing valve mixes the mixture of hot water elements with said second water source supplied through said water pipe.

8. The heat pump type hot water supply apparatus as claimed in claim 1, wherein said at least one inner portion of said hot water supply tank is connected at a top portion of said hot water supply tank and at least one inner portion of said hot water supply tank is connected at an intermediate portion between the top portion and a bottom portion of said hot water supply tank.

9. The heat pump type hot water supply apparatus as claimed in claim 1, wherein said hot water supply unit further includes a water—water heat exchanger for performing the heat exchange between the hot water supplied from said hot water supply tank and hot-water/water circulated in a bath tub to reheat the hot-water/water in the bath tub.

* * * * *